166-250
FIP8011 OR 4,022,276

United States Patent [19]
Dreher et al.
[11] 4,022,276
[45] May 10, 1977

[54] METHOD OF SELECTING OIL RECOVERY FLUIDS USING NUCLEAR MAGNETIC RESONANCE MEASUREMENTS

[75] Inventors: Karl D. Dreher; Robert D. Sydansk, both of Littleton, Colo.

[73] Assignee: Marathon Oil Company, Findlay, Ohio

[22] Filed: Feb. 13, 1976

[21] Appl. No.: 657,784

[52] U.S. Cl. ..... 166/250; 166/252; 324/.5 G

[51] Int. Cl.² ..... E21B 47/00; G01N 27/78; G01R 33/08

[58] Field of Search ..... 324/.5 R, .5 G; 166/252, 250, 305 R, 247

[56] References Cited

UNITED STATES PATENTS

| | | | |
|---|---|---|---|
| 3,128,425 | 4/1964 | Codrington | 324/.5 G |
| 3,213,357 | 10/1965 | Brown et al. | 324/.5 G |
| 3,289,072 | 11/1966 | Schuster | 324/.5 G |
| 3,456,183 | 7/1969 | Codrington et al. | 324/.5 G |
| 3,504,744 | 4/1970 | Davis, Jr. et al. | 166/252 |
| 3,528,000 | 9/1970 | Schwede | 324/.5 G |
| 3,561,530 | 2/1971 | Tosch et al. | 166/252 |
| 3,643,738 | 2/1972 | Dreher et al. | 166/252 |

*Primary Examiner*—Stephen J. Novosad
*Attorney, Agent, or Firm*—Joseph C. Herring; Jack L. Hummel

[57] ABSTRACT

Fluids are injected into porous strata for many purposes. These include, for example, well stimulation, secondary-type oil recovery, mobility control, regulation of formation "wetness" and regulation of the encroachment of fluids. Fluids used for the above purposes are readily selected using nuclear magnetic resonance (NMR) measurements in the laboratory to measure the interaction between the fluids being injected into the reservoir rock and the in situ fluids or between injected fluids and the porous material. NMR measurements are taken for each component of sample fluids proposed to be injected in the reservoir for a desired purpose, or the sample fluid per se and each of the in situ fluids. NMR measurements are then taken of the interaction between the nuclei of sample fluids injected, the reservoir rock, and the nuclei of fluids in situ.

If the injected fluid is to be used for some purposes, for example, well stimulation or secondary-type oil recovery, the fluids are selected which interact least with the rock and with in situ fluids. If the wetness of the reservoir is to be changed, then the fluid is selected which interacts well with the reservoir rock. If a material is to be precipitated or formed in situ, the fluid is selected which interacts well with either the reservoir rock or the formation fluids. Additionally, the best combination of components for a particular fluid to be injected can also be determined using NMR, preferably pulsed, detection devices.

8 Claims, 30 Drawing Figures

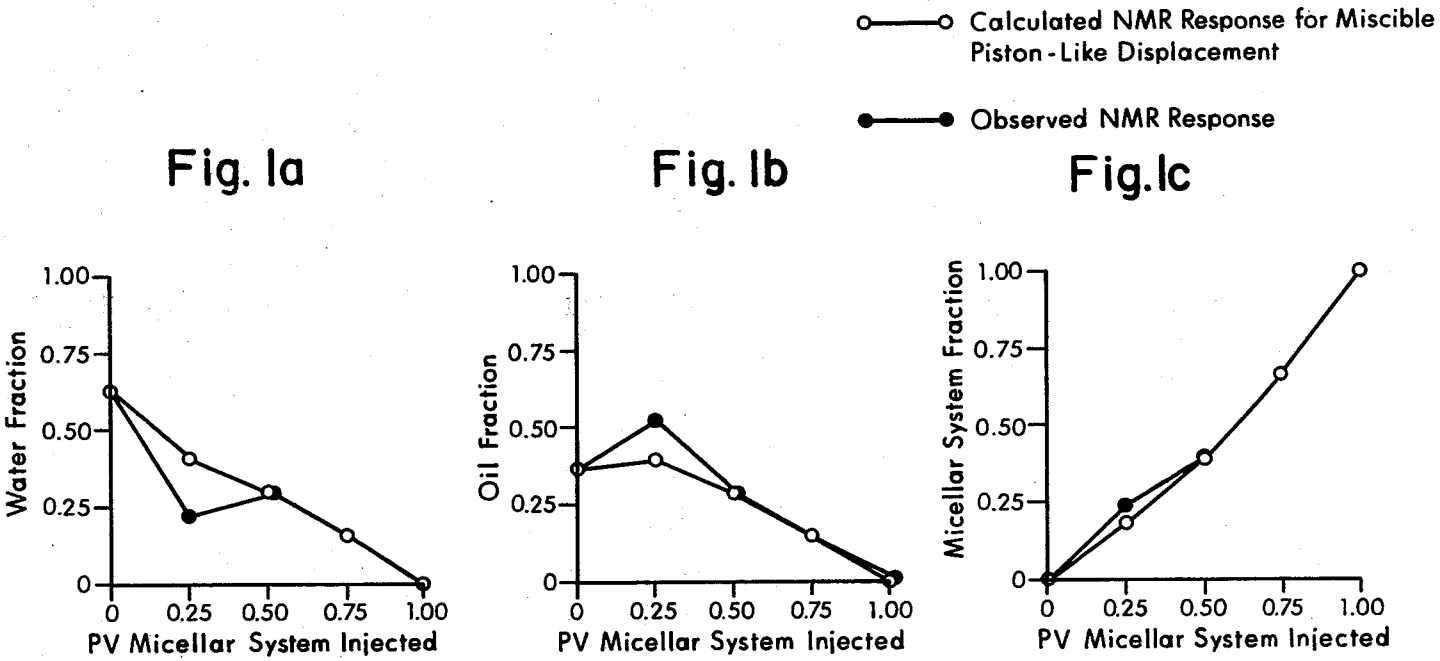
Water - External Slug — Water and Surfactant Response Displacing Water and Decane From Sandstone Core
Oil Recovery = 97% at 1 PV Micellar System Injection

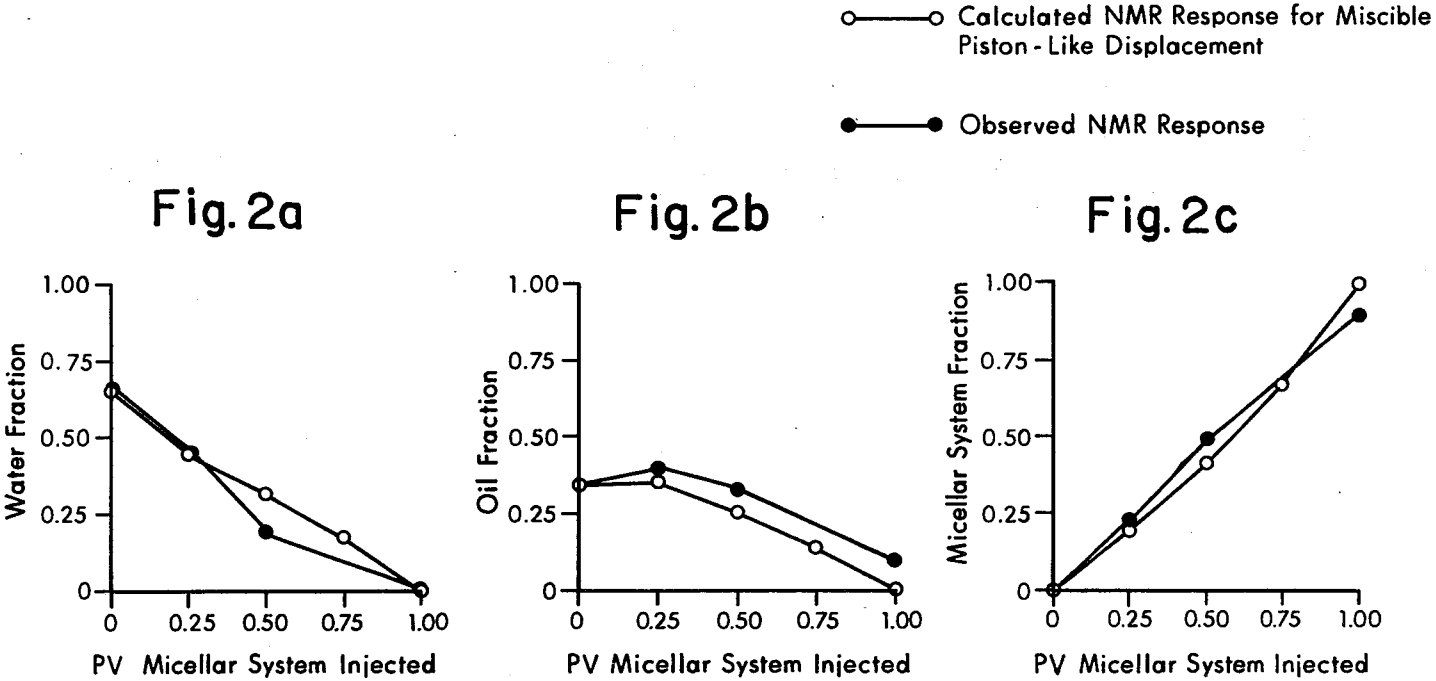
Water - External Slug—Water and Surfactant Response Displacing Water and Decane From Ceramic Core.
Oil Recovery = 71% at 1 PV Micellar System Injection

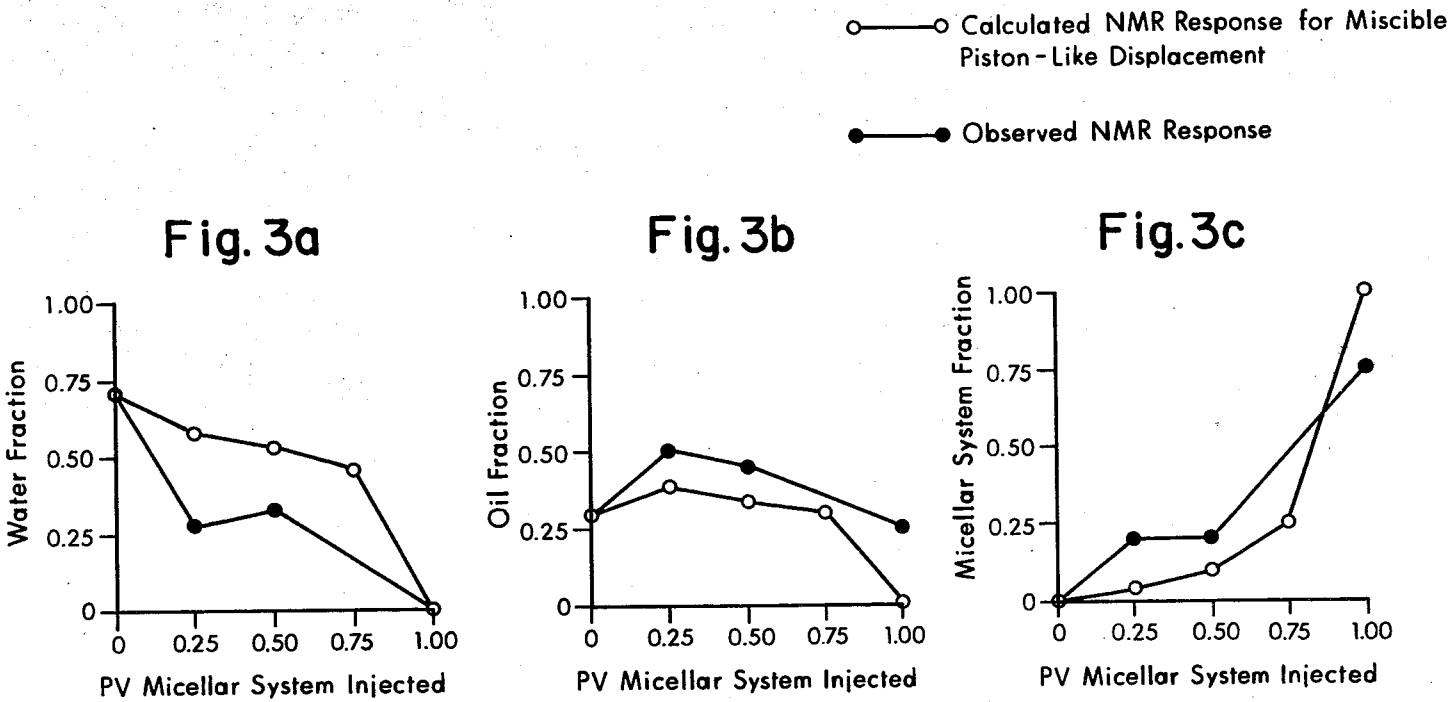
Water - External Slug — Surfactant Response Displacing Water and Decane From Sandstone Core.
Oil Recovery = 17% at 1 PV Micellar System Injection

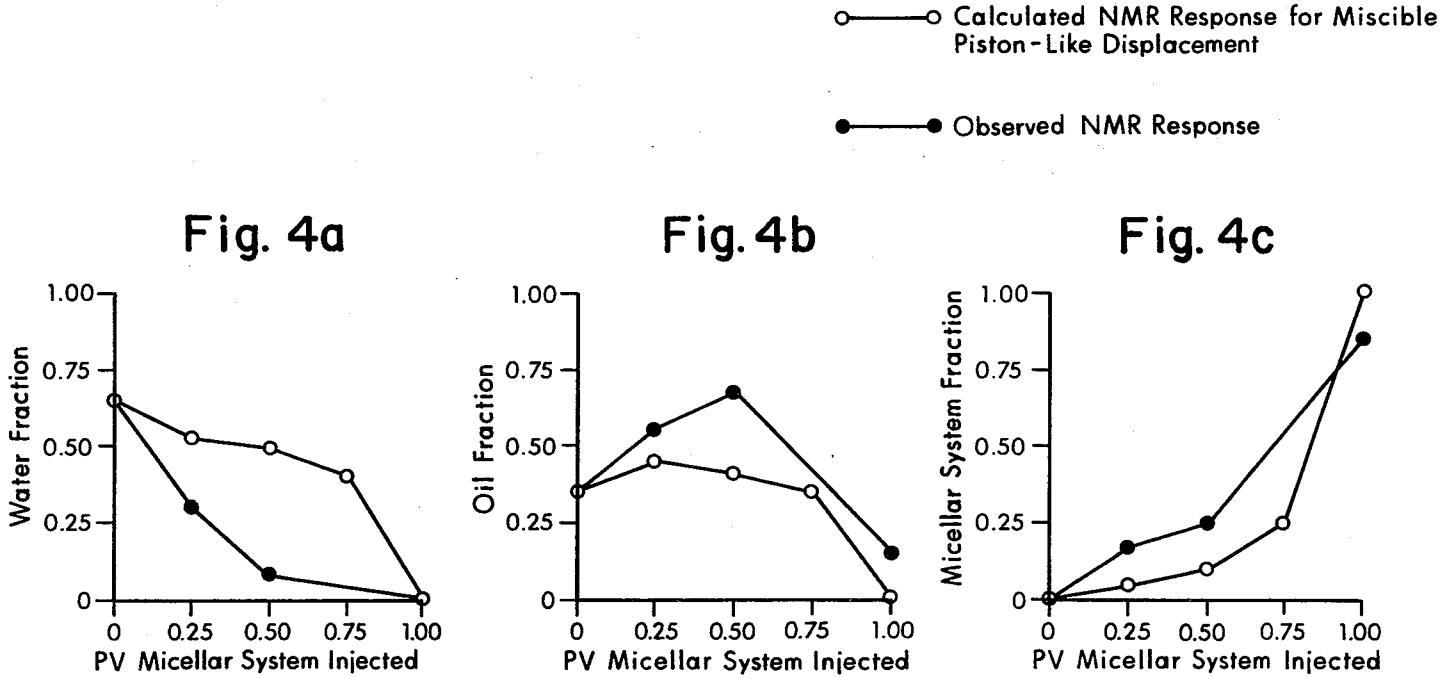
Water-External Slug – Surfactant Response Displacing Water and Decane From Ceramic Core
Oil Recovery = 56% at 1 PV Micellar System Injection

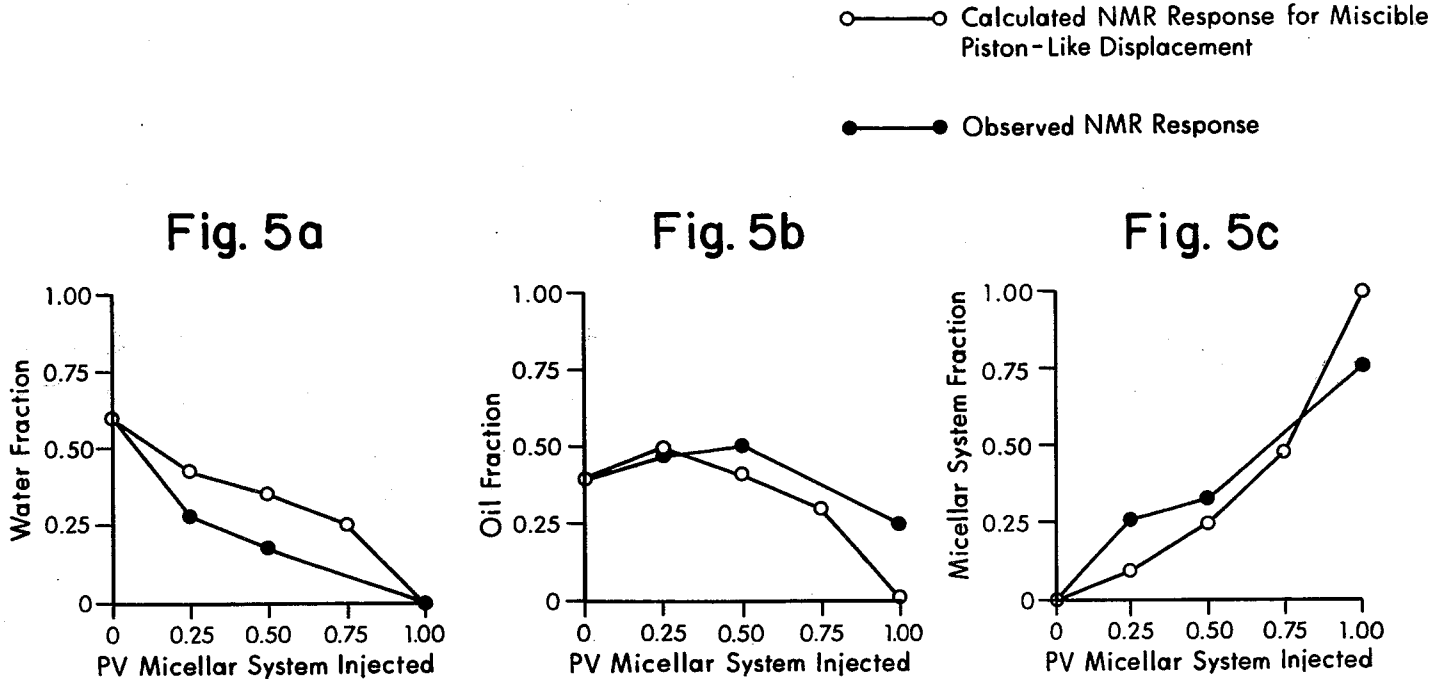
Oil-External Slug — Water and Surfactant Response Displacing Water and Decane From Sandstone Core.
Oil Recovery = 40% at 1 PV Micellar System Injection

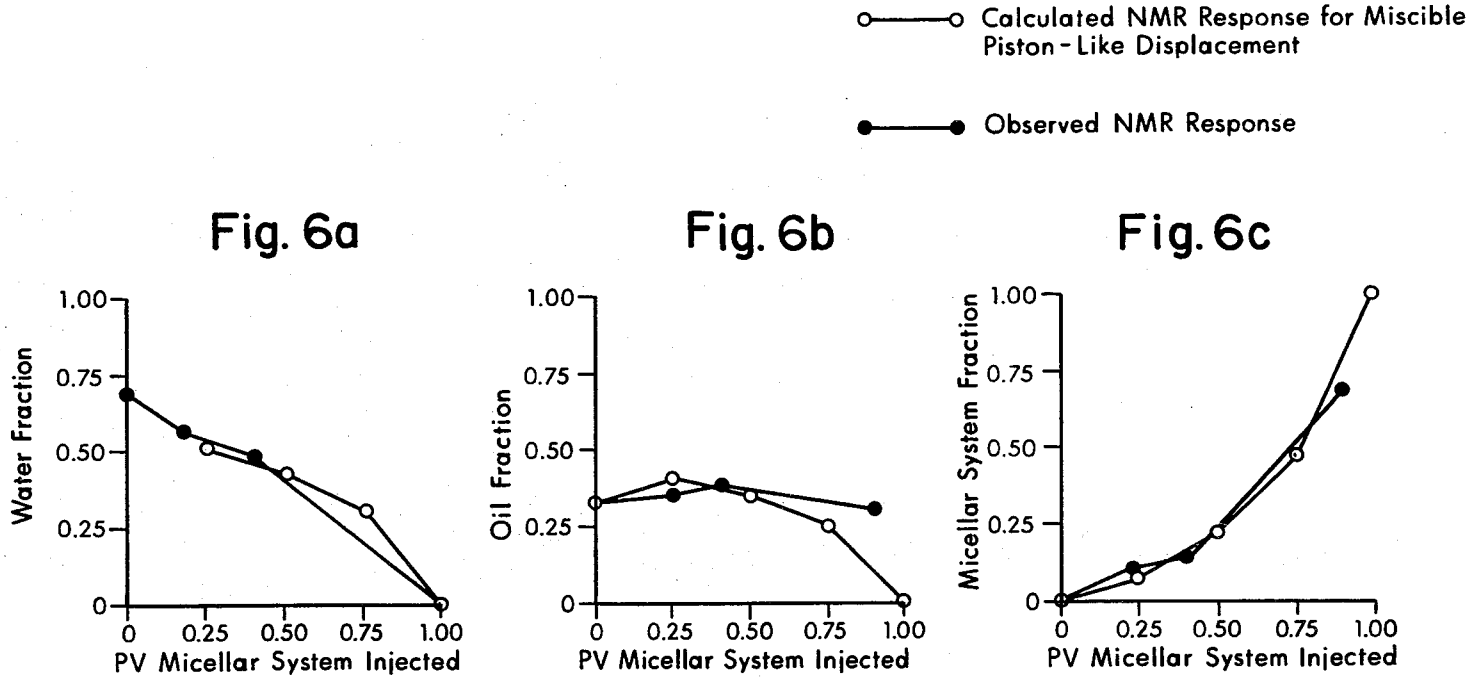
Oil-External Slug — Water and Surfactant Response Displacing Water and Decane From Ceramic Core.
Oil Recovery = 6% at 0.9 PV Micellar System Injection

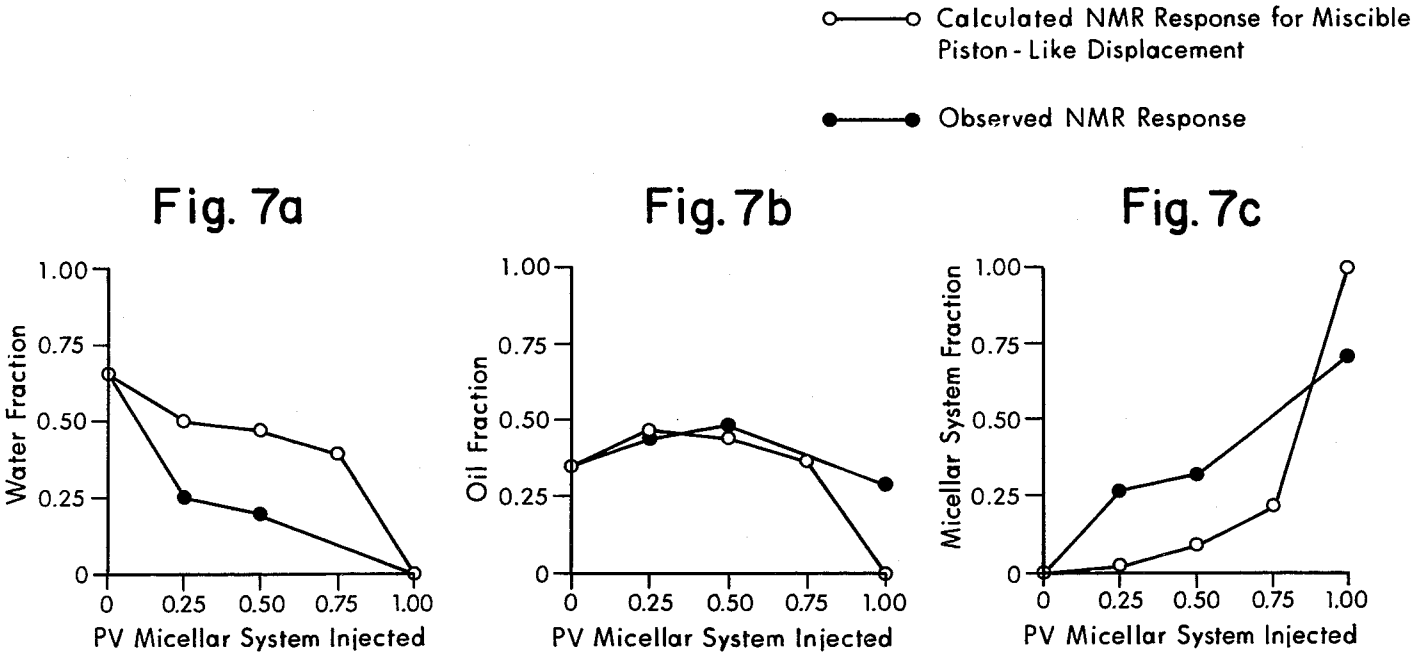
Oil - External Slug — Surfactant Response Displacing Water and Decane From Sandstone Core.
Oil Recovery = 19% at 1 PV Micellar System Injection

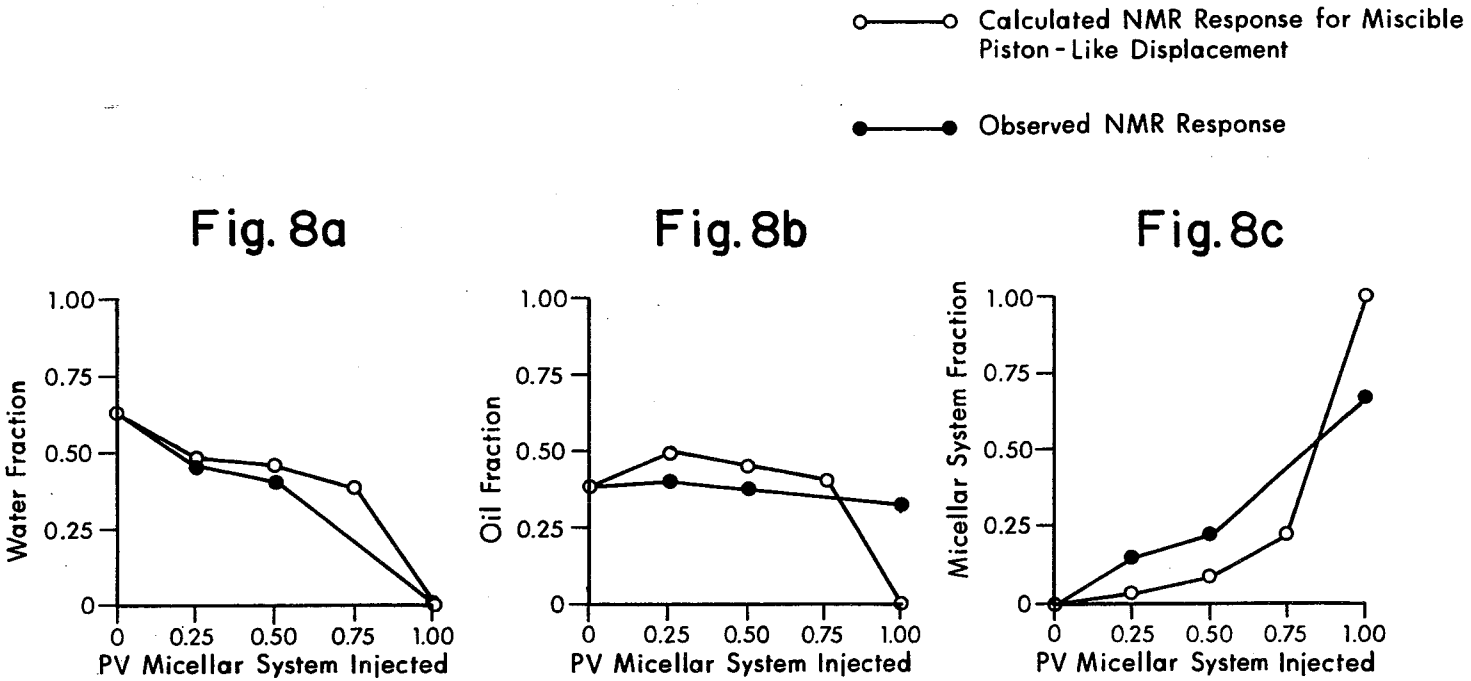
Oil - External Slug — Surfactant Response Displacing Water and Decane From Ceramic Core.
Oil Recovery = 16% at 1 PV Micellar System Injection

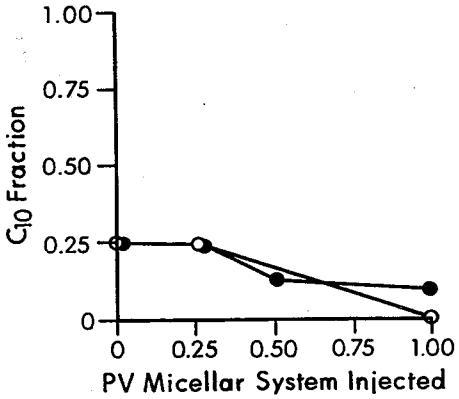
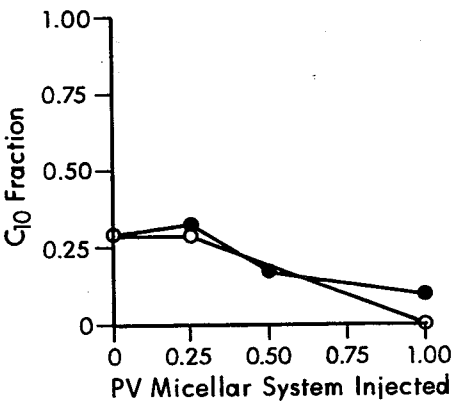
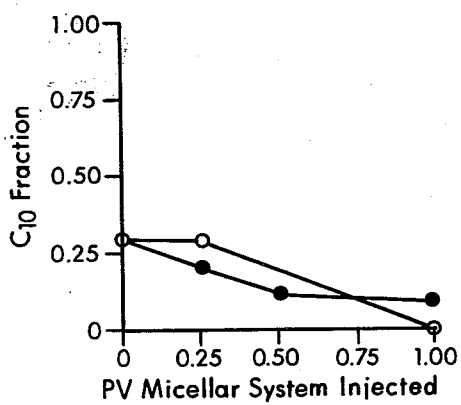
* Primary Amyl Alcohol 250 ppm $CaCl_2$ 750 ppm $CaCl_2$ 4,000 ppm $CaCl_2$

METHOD OF SELECTING OIL RECOVERY FLUIDS USING NUCLEAR MAGNETIC RESONANCE MEASUREMENTS

BACKGROUND OF THE INVENTION

1. Field of the Invention

This invention relates to the injection of fluids having nuclei detectable by NMR measuring devices into wells for purposes of well stimulation, secondary-type oil recovery, reservoir modification, permeability control, and fluid encroachment prevention; and the selection of materials for such uses. More particularly, it relates to the injection of fluids, containing nuclei detectable by NMR detection devices, which interact with the reservoir and/or with fluids in the reservoir in conformance with predetermined criteria.

2. Description of the Prior Art

Pulsed NMR has been used in the field of well logging to determine the presence of hydrocarbons. See U.S. Pat. Nos. 3,456,183, 3,289,072, and 3,528,000; publications by Loren et al, *Soc. Petrol. Engrs. Preprint* 2529 (1969), Timur et al, *Soc. Petrol. Well Logging Analysts Symposium*, (May 2–5, 1971); Senturia et al, Soc. Petrol. Engrs. Journal (Sept. 1970), p. 237. In the course of some of these logging processes, fluids have paramagnetic properties have been injected to cancel out the "noise" background of water in the reservoir. Nuclear magnetic resonance has also been utilized in the analysis of a wide variety of liquid-solid systems, e.g. in biology, in geology (in the determination of the water saturation of clays).

Many fluids are used in petroleum production operations which contain nuclei detectable by NMR devices, such as the pulsed NMR detection devices. The fluids used in these processes include semi-polar compounds such as alcohols used as cosurfactants, surfactants of various sorts such as the petroleum sulfonate surfactants and certain polymers. These fluids are used in a variety of processes where fluids are injected into wells drilled into formations. These include injection for corrosion inhibition, U.S. Pat. No. 3,072,192; oil recovery, U.S. Pat. Nos. 3,254,714, 3,261,399, 3,506,070, 3,599,715, and 3,759,325; separation of gas and oil and oil and water interfaces, U.S. Pat. Nos. 3,495,661 and 3,710,861; well stimulation, U.S. Pat. No. 3,568,772; water coning inhibition, U.S. Pat. No. 3,554,288; prevention of salt water encroachment, U.S. Pat. No. 3,587,737; formation fracturing, U.S. Pat. No. 3,603,400; plugging, U.S. Pat. No. 3,604,508, acidizing, U.S. Pat. No. 3,831,679 and in drilling fluids, U.S. Pat. No. 3,734,856. The fact that the processes of the instant invention can be used with such a wide variety of oil field operations makes the invention particularly important.

SUMMARY OF THE INVENTION

Many references teach well treatment and oil recovery techniques. Many of these processes use fluids which can be designed through use of NMR techniques to design fluids having minimal interaction.

The procedures pertinent to secondary-type oil recovery are also useful in selecting fluids for well stimulation, prevention of fluid encroachment and foam flooding. In other instances, the fluids injected must react with either fluids in the reservoir or with the reservoir itself. These include some forms of prevention of fluid encroachment, plugging, mobility control and acidizing. In such instances, the fluids selected for injection will be those which are most interactive with the fluids in the reservoir and/or the reservoir rock itself. From the above, it is readily apparent that one desiring to use NMR in injected fluid selection will have to predetermine the criteria necessary for the fluid to be injected. That is, whether the fluid will or will not interact with the fluid and/or rock in the reservoir.

The term "interact" for purposes of this invention, means:

a. the chemical reaction of injected fluid or components thereof with organic or inorganic components of reservoir fluids to form precipitate, to form a surface tension changing agent, to provide a compound for changing the rate of chemical or physical reaction or change, or to change permeability of all or a portion of a reservoir;
b. the changing of surface tension;
c. the sorption of injected material onto or the elution of material from the rock surface;
d. the dissolution of injected particles; or
e. solution or solubilization of fluids by fluids containing surfactant and/or semi-polar organic compounds.

DESCRIPTION OF THE INVENTION

This invention comprises contacting a porous matrix substantially representative of a fluid-bearing subterranean strata with fluids containing nuclei detectable by nuclear magnetic resonance measuring devices and selected by: determining the NMR response to each nuclei-bearing fluid in association with said matrix, determining the NMR response of one or more samples of each fluid or component thereof to be brought into contact with the matrix, determining the NMR response of each such sample fluid or component thereof while in contact with the fluids in association with said matrix in said matrix, and contacting the subterranean strata with the fluid which substantially meets predetermined criteria for interaction with the matrix and/or fluid associated with the matrix.

The process is preferably used in processes for the production of crude oil and most preferably in the selection of fluids for secondary type oil recovery.

While the process is useful in any of the processes described in the above-listed patents, it will be most particularly described with reference to secondary-type oil recovery operations, i.e., recovery operations after completion of primary oil recovery.

More specifically, the selection of various ingredients for use in oil recovery can be made on the basis of core floods monitored by nuclear magnetic resonance detection devices; preferably, by pulsed nuclear magnetic resonance. Generally, a measurement, e.g. spin-lattice relaxation time (T), is separately made for each of the components of the fluid to be injected into the reservoir and of the whole fluid(s) to be injected, and for each of the in situ reservoir fluids as reconstituted within the core. A portion of the oil and in situ water is then displaced by injection of a quantity of the injected displacement fluids. The NMR measurements are then taken for the core together with each of the injected and in situ components. Fluids which contribute minimally to the displacement of the in situ fluids and/or which are destroyed by interaction with the in situ fluids and/or the rock sample are replaced by fluids or fluid components which interact with the in situ fluids in the rock to better displace one or more of the in situ fluids and/or enhance the integrity of the injected fluids. For example, nonyl phenol can be substituted for a more water-soluble alcohol such as isopropanol if a micellar dispersion which is relatively hydrophilic in character containing isopropanol is destroyed by the in situ fluids and a more hydrophobic dispersion is required or a lower mean equivalent weight petroleum sulfonate can be substituted if the NMR measurements indicate a need for a more hydrophilic micellar system.

The invention will find its primary use in the selection of micellar systems of water and surfactant; water, surfactant, and cosurfactant; or water, surfactant, cosurfactant, and hydrocarbon (whether oil-external, water-external, or of intermediate externality), water and cosurfactant (alcohol) systems for use in various processes leading to oil recovery.

BRIEF DESCRIPTION OF DRAWINGS

FIGS. 1*a*, 1*b* and 1*c* are graphic representations of the results of Example 2 in which the "ideal" or expected NMR response for a miscible piston-like displacement (shown by open circles) is compared to the measured or observed NMR response of the displacement liquid. Curve A shows the amount (in pore volumes) of slug injected vs. the water displaced by the PV slug; Curve B shows the amount of slug injected vs. the oil displaced by the slug; Curve C shows the amount of slug injected vs. the intact slug in the core. The difference between the ideal NMR response and the observed NMR response in any of the curves is indicative of an ineffective displacement fluid. (FIGS. 3–9 relate the same type of information but in relation to different examples.)

FIGS. 2*a*, 2*b* and 2*c* are graphic representations of NMR outputs of Example III.

FIGS. 3*a*, 3*b* and 3*c* are graphic representations of NMR outputs of Example IV.

FIGS. 4*a*, 4*b* and 4*c* are graphic representations of the NMR outputs of Example V.

FIGS. 5*a*, 5*b* and 5*c* are graphic representations of the NMR outputs of Example VI.

FIGS. 6*a*, 6*b* and 6*c* are graphic representations of the NMR outputs of Example VII.

FIGS. 7*a*, 7*b* and 7*c* are graphic representations of the NMR outputs of Example VIII.

FIGS. 8*a*, 8*b* and 8*c* are graphic representations of the NMR outputs of Example IX.

FIGS. 9*a*, 9*b* and 9*c* are graphic representations of the NMR outputs of Example X.

Each of the curves shows the amounts of PV slug injected vs. the oil displaced by the slug. As the proportion of $CaCl_2$ in the displacement liquid increased from Curve A to Curve C, the difference between the ideal NMR output and the observed NMR output for the displacement liquid decreased and the percentage of oil recovery increased.

Figure 10A:
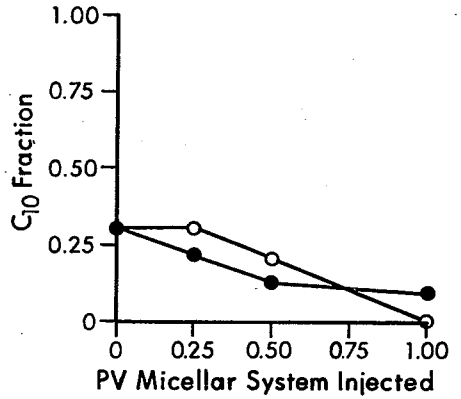
Figure 10B:
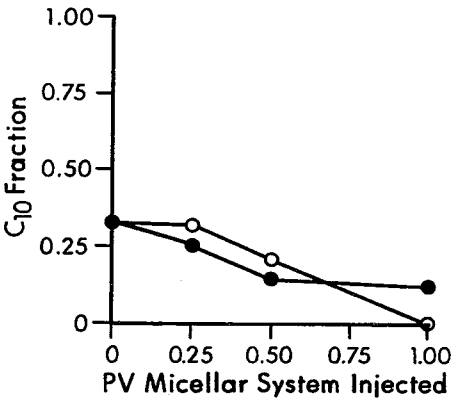
Figure 10C:
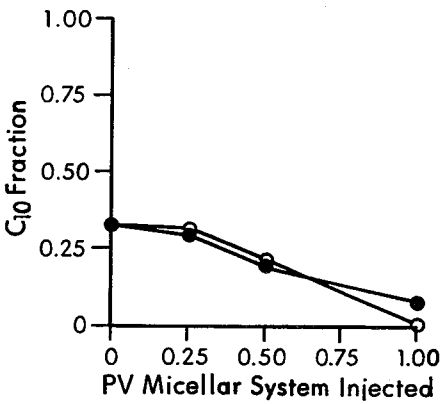

FIGS. 10*a*, 10*b* and 10*c* are graphic representations of the NMR outputs of Example XI. The curves represent the amount of slug injected vs. the amount of oil displaced by the slug, and show the changes in the difference between the ideal NMR output and the observed NMR output of the displacement liquid as the proportion of primary amyl alcohol of the displacement liquid is altered. The curve which shows the least difference between the ideal and observed NMR output is of the sample showing the greatest oil recovery.

DESCRIPTION OF THE PREFERRED EMBODIMENTS

NMR Outputs: The NMR outputs utilized with the invention can be the free induction decay amplitude which is proportional to the concentration of responding materials or can be the spin-lattice relaxation rate or the spin-spin relaxation rate of the individual component. For additional precision of selection of components, the change in both the relaxation time and the amplitude of a particular component can be observed.

NMR Apparatus: Conventional wideband pulsed NMR apparatus including those commercially available can be utilized without modification. The data presented herein were obtained by the use of a wideband pulsed NMR, Model No. B-KR-322S, produced by Bruker-Physik AG of Karlsruhe, Germany. The instruction manual contains a list of 51 nuclei useful in forming desired fluids. As used herein, "NMR" also includes nuclear magnetic log and analogous techniques.

Analytical Techniques: A convenient technique for use with the present invention is to utilize small cores, e.g. the 0.89 cm diameter by 2.0 cm long cores from the reservoir to be flooded or another representative rock. The more common 1-inch (2.54 cm) by 3-inch (7.62 cm) cores may also be employed provided the apparatus utilized for measuring NMR can accommodate them. Discs and larger cores can be substituted if they can be accommodated by the NMR apparatus.

Displacement Fluid Components: The ingredients of the displacement fluid can be selected from those conventionally employed, e.g. micellar systems commonly containing hydrocarbons, sulfonates such as petroleum sulfonates, cosurfactants, e.g., isopropanol and water; alcohols, e.g., ethanol, isopropanol; surfactant floods comprising water and a surface active agent; thickened water floods in which the mobility of the displacement fluid is adjusted by the addition of polymers such as polyacrylamide, polyethylene oxide, carboxymethyl cellulose, biopolymers and the like. Polymers of the polar types listed are, however, difficult—and sometimes impossible—to measure utilizing pulsed nuclear magnetic resonance in its present state of development.

The methods needed to take the desired nuclear magnetic resonance measurements are well known to those skilled in the art as are the selection of fluids to be injected which contain sufficient amounts of protons to be measurable using nuclear magnetic resonance detecting devices. The particular method used, the temperature at which the measurements are made, etc. are not critical and any desired method may be selected. Preferably, however, the rock sample or matrix being utilized, the reservoir fluids, and fluid compositions being utilized, should closely simulate the actual reservoir conditions, rock and fluid compositions. Most preferably, the rock and fluids will be taken from the reservoir and measurements will be taken at reservoir temperatures.

Temperature: The temperature is not narrowly critical, but preferably, should be the same during each NMR measurement. Additional accuracy can be obtained by running both sets of NMR measurements at the approximate temperature to be encountered in the subterranean reservoir.

The following examples more fully describe the invention but are not to be taken as limiting:

EXAMPLE I

To illustrate the practice of the invention, a series of displacement processes in which decane (substituted for petroleum because its NMR characteristics are sharply different from those of the displacement fluids and provide better illustration of the practice of the invention) and water are displaced from sandstone and ceramic cores (as described in each of the tables below) with a water-external micellar dispersion (See British Pat. No. 1,378,724). The slugs are composed of different materials and interaction between slug components and the rock sample is observed as slug injection proceeds.

In each slug, the core (approximately 0.89 cm diameter by 20 cm length) is initially saturated with water, then flooded with decane to $S_{wi}$ followed by water to $S_{or}$, prior to injection of the slug. This process simulates tertiary recovery (after normal water flooding) of a petroleum reservoir. During injection of a micellar system, each flood is periodically stopped and a free induction decay of spin-lattice relaxation decay ($T_1$) measured by use of the specific NMR equipment described above. These NMR outputs are obtained for each of the nuclei-containing materials in the core. From these outputs, the slug saturation ($f_s$), water saturation ($f_w$) and oil saturation ($fc_{10}$) are determined from a knowledge of the $T_1$ of the components. In certain of the examples, in order to observe micellar slug solubilization by water in place and decane, the drive fluid is prepared with deuterium oxide in place of water and with a chlorocarbon in place of the hydrocarbon.

Data analysis is accomplished by comparing experimentally determined saturations to those expected for completely miscible piston-like displacement, i.e. "ideal" displacement. Other assumptions are that no oil is produced until after the first 0.25 PV of slug injection and that all in situ water and oil are produced at 1 PV slug injection.

EXAMPLE II

A water-external slug is prepared with $H_2O$ so that response from the slug is due to $H_2O$ and surfactant alone. Table 1 and FIG. 1 show the results obtained for the displacement from a sandstone core. FIG. 1 shows that this displacement is almost piston-like with respect to both oil and water. Only in the very early part of the flood is there some dilution of the slug by in situ water. By 0.5 PV slug injection, the water, oil and slug saturations follow exactly that expected for a miscible piston-like displacement. Oil recovery for the slug was 97% at 1 PV slug injection.

EXAMPLE III

Results for the same flood of Example II in a ceramic core are shown in Table 2 and FIG. 2. Unlike the flooding data shown in FIG. 1, there is a mild dilution of the slug of the in situ water at 0.5 PV slug injection. This leads to inefficient oil displacement, i.e. the oil saturation exceeds that expected, and an ultimate recovery of 71%.

EXAMPLES IV & V

These examples utilize similar floods to those of Examples II and III with the exception that the slug is prepared with $D_2O$ instead of water so that the only component of the slug that was seen by NMR was the surfactant. The results are as shown in Tables 3 and 4 and FIGS. 3 and 4. Oil recovery, 17% and 56% for both slugs respectively, is poor. This is due to immediate dilution of the slug by in situ water and an ultimate bypass of in-place oil.

EXAMPLES VI–IX

These examples are conducted in the same manner as were Examples II–V with the exception that the micellar slugs are oil-external. The results are shown in Tables 6–9 and FIGS. 6–9. The oil recovery of all of these examples are poor. The figures show the dilution of the slug by reservoir water is severe and occurs early in the floor. The extent of the dilution with water is more pronounced in the sandstone than in the ceramic core material. Following dilution with water the slug displaces only reservoir water and left the oil essentially in place. In the ceramic core material oil is solubilized into the slug; this is the only oil produced.

EXAMPLE X

Using the same technique employed in Examples II–IX and employing a micellar slug having the composition: 14.0 weight percent petroleum sulfonate (420 equivalent weight), 73.5 percent water, and 12.5 percent hydrocarbon, a sandstone core is first flooded with the slug alone and the NMR spin lattice relaxation rate measured. Similar individual measurements are made for the core saturated with petroleum-in-place and, separately with the reservoir water. The NMR outputs are shown as the closed curves in FIG. 11, graphs A, B and C. Curve A represents the first result using the above micellar system containing no primary amyl alcohol.

Next the core is flooded with the oil in place and thereafter flooded with water to simulate tertiary recovery as described above. The core is then successively flooded with 0.25, 0.50, and 1.0 pore volumes of micellar solution and the NMR spin lattice relaxation rate is measured at each point. These NMR values measured on the combination of fluids are shown as the black circles in Curve A.

Comparison of the calculated NMR curve (open circles) and the composite NMR curve (black circles) indicates substantial differences between the respective values, indicating that the micellar system will be relatively inefficient during an actual displacement flood.

Accordingly, 0.75 mls of primary amyl alcohol per 100 gms slug is added to a reformation of the above micellar displacement slug and the individual NMR measurements, the calculations and the composite NMR measurements are repeated as above. Inspection of graph 9B indicates that the differences in NMR values are substantially lessened, indicating the improvement in predicted efficiency caused by the addition of the primary amyl alcohol.

To determine whether further efficiency can be obtained by adding more primary amyl alcohol, graph 9C is obtained using corresponding measurements on a slug containing 1.58 mls of an amyl alcohol per 100 gms of slug. As can be seen from inspection of graph 9C, the predicted efficiency is not improved so the expense of adding these additional quantities of a relatively expensive alcohol component can be avoided.

EXAMPLE XI

Using the same techniques employed in Example X and the same basic micellar slug composition, the effect of the amount of calcium chloride dissolved in the in situ water is studied.

Inspection of graphs 10A, 10B, and 10C readily shows that the micellar system of graph 10C described in Example X above, is most efficient in reservoirs containing in situ water having high (4,000 ppm) calcium chloride compositions.

TABLE 1

WATER-EXTERNAL SLUG - $H_2O$ AND SURFACTANT RESPONSE
SANDSTONE CORE

| Core* Condition | PV Flood | $f_s$ | $f_w$ | $f_{c10}$ | $T_s$(msec) | $T_w$(msec) | $T_{c10}$(msec) |
|---|---|---|---|---|---|---|---|
| 100% $H_2O$ | | 0.28 | 0.72 | — | 52 | 340 | — |
| 100% Slug** | | 0.24 | 0.76 | — | 20 | 180 | — |
| $C_{10}$ displaced by $H_2O$ | 10 | 0.63 | — | 0.37 | 130 | — | 1600 |
| $H_2O/C_{10}$ displaced by Slug | 0.25 | 0.26 | 0.22 | 0.52 | 91 | 180 | 1600 |
| | 0.5 | 0.41 | 0.30 | 0.29 | 110 | 190 | 1600 |
| | 1.0 | 0.26 | 0.74 | < 0.01 | 43 | 270 | 1600 |
| | 5.0 | 0.23 | 0.77 | < 0.01 | 35 | 250 | 1600 |

*Sandstone core - [C. Neville No. 2, Byron Tensleep], porosity, $\Phi = 20\%$, permeability, k = 120 mD
**Slug composition
8.5 wt % 410 EW gas oil sulfonate
59.6 wt % $H_2O$
28.6 wt % Chlorocarbon ($C_4Cl_6$)
3.3 wt % IPA
Slug relaxation characteristics: $f_s = 0.07$, $T_s = 40$ msec, $T_L = 1800$ msec
Brookfield viscosity = 35 cp at 6 rpm
f = fraction
T = spin-lattice relaxation decay time
s = slug
w = water
$C_{10}$ = oil (decane)

TABLE 2

WATER-EXTERNAL SLUG- $H_2O$ AND SURFACTANT RESPONSE
CERAMIC CORE

| Core* Condition | PV Flood | $f_s$ | $F_w$ | $f_{c10}$ | $T_s$(msec) | $T_w$(msec) | $T_{c10}$(msec) |
|---|---|---|---|---|---|---|---|
| 100% $H_2O$ | — | 1.0 | — | — | 640 | — | — |
| 100% Slug** | — | 0.44 | 0.56 | — | 220 | 610 | — |
| $C_{10}$ displaced by $H_2O$ | 10 | 0.66 | — | 0.34 | 370 | — | 1600 |
| $H_2O/C_{10}$ displaced by Slug | 0.25 | 0.23 | 0.38 | 0.39 | 230 | 450 | 1600 |
| | 0.5 | 0.49 | 0.19 | 0.32 | 230 | 810 | 1600 |
| | 1.0 | 0.51 | 0.39 | 0.10 | 210 | 560 | 1600 |
| | 4.0 | 0.38 | 0.62 | 0.01 | 170 | 450 | 1600 |

*Ceramic Core (DP 12C), $\Phi = 40\%$, k = 210 ml)
**Slug composition
8.5 wt % 410 EW gas oil sulfonate
59.6 wt % $H_2O$
28.6 wt % Chlorocarbon ($C_4Cl_6$)
3.3 wt % IPA
Slug relaxation characteristics: $f_s = 0.07$, $T_s$ 32 40 msec, $T_L = 1800$ msec
Brookfield viscosity = 35 cp at 6 rpm

TABLE 3

WATER-EXTERNAL SLUG - SURFACTANT RESPONSE
SANDSTONE CORE

| Core* Condition | PV Flood | $f_s$ | $f_w$ | $f_{c10}$ | $T_s$(msec) | $T_w$(msec) | $T_{c10}$(mesc) |
|---|---|---|---|---|---|---|---|
| 100% $H_2O$ | — | 0.28 | 0.72 | — | 52 | 340 | — |
| 100% Slug** | — | 0.33 | 0.67 | — | 42 | 260 | — |
| $C_{10}$ displaced by $H_2O$ | 10 | 0.70 | — | 0.30 | 120 | — | 1600 |
| $H_2O/C_{10}$ displaced by Slug | 0.25 | 0.21 | 0.28 | 0.51 | 44 | 260 | 1600 |
| | 0.50 | 0.21 | 0.33 | 0.46 | 38 | 250 | 1600 |
| | 1.0 | 0.06 | 0.69 | 0.25 | 40 | 150 | 1600 |
| | 5.0 | 0.19 | 0.67 | 0.14 | 38 | 170 | 1600 |

*Sandstone core - C. Neville No. 2, $\Phi = 20\%$, k = 120 mD
**Slug composition:
8.0 wt % 410 EW gas oil sulfonate
61.8 wt % $D_2O$
27.0 wt % Chlorocarbon ($C_4Cl_6$)
3.2 wt % IPA
Slug relaxation characteristics: $f_s = 0.50$, $T_s = 34$ msec, $T_L = 560$ msec
Brookfield viscosity = 46 cp at 6 rpm

TABLE 4

WATER-EXTERNAL SLUG - SURFACTANT RESPONSE
CERAMIC CORE

| Core* Condition | PV Flood | $f_s$ | $f_w$ | $f_{c10}$ | $T_s$ (msec) | $T_w$(msec) | $T_{c10}$ (msec) |
|---|---|---|---|---|---|---|---|
| 100% $H_2O$ | | 1.0 | — | — | 640 | — | — |
| 100 % Slug** | | 0.49 | 0.51 | — | 130 | 830 | — |
| $C_{10}$ displaced by $H_2O$ | 10 | 0.66 | — | 0.34 | 330 | — | 1600 |
| $C_{10}/H_2O$ displaced by Slug | 0.25 | 0.17 | 0.29 | 0.54 | 99 | 410 | 1600 |
| | 0.5 | 0.25 | 0.08 | 0.67 | 92 | 340 | 1600 |

TABLE 4-continued

| WATER-EXTERNAL SLUG - SURFACTANT RESPONSE CERAMIC CORE | | | | | | | |
|---|---|---|---|---|---|---|---|
| Core* Condition | PV Flood | $f_s$ | $f_{tr}$ | $f_{c10}$ | $T_s$ (msec) | $T_{tr}$(msec) | $T_{c10}$ (msec) |
| | 1.0 | 0.44 | 0.41 | 0.15 | 120 | 950 | 1600 |
| | 5.0 | 0.41 | 0.42 | 0.17 | 100 | 420 | 1600 |

*Ceramic Core (DP 12C), $\Phi = 40\%$, k = 210 mD
**Slug composition:
8.0 wt % 410 EW gas oil sulfonate
61.8 wt % $D_2O$
27.0 wt % Chlorocarbon ($C_4Cl_6$)
3.2 wt % IPA
Slug relaxation characteristics: $f_s$=0.5, $T_s$=34 msec, $T_l$=560 msec
Brookfield viscosity=46 cp at 6 rpm

TABLE 5

| OIL-EXTERNAL SLUG - $H_2O$ AND SURFACTANT RESPONSE SANDSTONE CORE | | | | | | | |
|---|---|---|---|---|---|---|---|
| Core* Condition | PV Flood | $f_s$ | $f_{tr}$ | $f_{c10}$ | $T_s$ (msec) | $T_{tr}$ (msec) | $T_{c10}$(msec) |
| 100% $H_2O$ | — | 0.28 | 0.72 | — | 52 | 340 | — |
| 100% Slug** | — | 0.38 | 0.62 | — | 11 | 89 | — |
| $H_2O$ displaced by $C_{10}$ | 15 | 0.29 | — | 0.71 | 44 | — | 1600 |
| $C_{10}$ displaced by $H_2O$ | 15 | 0.18 | 0.42 | 0.40 | 20 | 200 | 1600 |
| $H_2O/C_{10}$ displaced by Slug | 0.25 | 0.26 | 0.27 | 0.47 | 30 | 220 | 1600 |
| | 0.50 | 0.32 | 0.18 | 0.50 | 32 | 240 | 1600 |
| | 1.0 | 0.38 | 0.38 | 0.24 | 32 | 290 | 1600 |
| | 6.0 | 0.39 | 0.57 | 0.04 | 19 | 150 | 1600 |

*Sandstone core - c. Neville No. 2, $\Phi = 20\%$, k = 120 mD
**Slug composition:
7.1 wt % Shell Sulfonate
19.1 wt % $H_2O$
2.8 wt % IPA
71.0 wt % Chlorocarbon ($C_4Cl_6$)
Slug relaxation characteristics: $f_2 = 0.20$, $T_s = 75$ msec, $T_l = 1600$ msec
Brookfield viscosity = 26 cp at 6 rpm

TABLE 6

| OIL-EXTERNAL SLUG - $H_2O$ AND SURFACTANT RESPONSE CERAMIC CORE | | | | | | | |
|---|---|---|---|---|---|---|---|
| Core* Condition | PV Flood | $f_s$ | $f_{tr}$ | $f_{c10}$ | $T_s$ (msec) | $T_{tr}$ (msec) | $T_{c10}$ (msec) |
| 100% $H_2O$ | | 1.0 | | | 640 | | |
| 100% Slug** | | 0.38 | 0.62 | | 62 | 340 | |
| $C_{10}$ displaced by $H_2O$ | 10 | 0.67 | — | 0.33 | 300 | — | 1600 |
| $H_2O/C_{10}$ displaced by Slug | 0.2 | 0.10 | 0.56 | 0.34 | 62 | 342 | 1600 |
| | 0.4 | 0.16 | 0.47 | 0.37 | 61 | 350 | 1600 |
| | 0.9 | 0.21 | 0.48 | 0.31 | 59 | 270 | 1600 |
| | 5.0 | 0.39 | 0.54 | 0.07 | 73 | 340 | 1600 |

*Ceramic core (DP 12C), $\Phi = 40\%$, k = 210 mD
**Slug composition:
7.1 wt % Shell Sulfonate
19.1 wt % $H_2O$
2.8 wt % IPA
71.0 wt % Chlorocarbon ($C_4Cl_6$)
Slug relaxation characteristics: $f_s = 0.20$, $T_s$ =75 msec, $T_l$ = 1600 msec
Brookfield viscosity = 26 cp at 6 rpm

TABLE 7

| OIL-EXTERNAL SLUG - SURFACTANT RESPONSE SANDSTONE CORE | | | | | | | |
|---|---|---|---|---|---|---|---|
| Core* Condition | PV Flood | $f_s$ | $f_{tr}$ | $f_{c10}$ | $T_s$ (msec) | $T_{tr}$ (msec) | $T_{c10}$ (msec) |
| 100% $H_2O$ | | 0.28 | 0.72 | — | 52 | 340 | — |
| 100% Slug** | | 0.27 | 0.73 | — | 54 | 120 | — |
| $H_2O$ displaced by $C_{10}$ | 15 | 0.29 | — | 0.71 | 44 | — | 1600 |
| $C_{10}$ displaced by $H_2O$ | 15 | 0.21 | 0.43 | 0.36 | 20 | 160 | 1700 |
| $H_2O/C_{10}$ displaced by Slug | 0.25 | 0.27 | 0.27 | 0.46 | 30 | 170 | 1500 |
| | 0.50 | 0.32 | 0.21 | 0.47 | 30 | 200 | 1700 |
| | 1.0 | 0.39 | 0.32 | 0.29 | 30 | 220 | 1400 |
| | 5.0 | 0.28 | 0.72 | — | 22 | 170 | — |

*Sandstone core - C. Neville No.2, $\Phi = 20\%$, k = 120 mD
**Slug composition
6.9 wt % Shell sulfonate
20.6 wt % $D_2O$
2.8 wt % IPA
69.7 wt % Chlorocarbon ($C_4Cl_6$)
Slug relaxation characteristics: $f_s = 0.61$, $T_s = 90$ msec, $T_l = 770$ msec

TABLE 8

OIL-EXTERNAL SLUG - SURFACTANT RESPONSE
CERAMIC CORE

| Core* Condition | PV Flood | $f_s$ | $f_w$ | $f_{c10}$ | $T_s$ (msec) | $T_w$ (msec) | $T_{c10}$ (msec) |
|---|---|---|---|---|---|---|---|
| 100% $H_2O$ | — | 1.0 | | | 640 | | |
| 100% Slug** | — | 0.46 | 0.54 | | 66 | 300 | |
| $C_{10}$ displaced by $H_2O$ | 10 | 0.62 | — | 0.38 | 290 | | 1600 |
| $H_2O/C_{10}$ displaced by Slug | 0.25 | 0.16 | 0.44 | 0.40 | 59 | 350 | 1600 |
| | 0.50 | 0.23 | 0.39 | 0.38 | 60 | 330 | 1600 |
| | 1.0 | 0.26 | 0.42 | 0.32 | 62 | 290 | 1600 |
| | 5.0 | 0.31 | 0.56 | 0.13 | 62 | 200 | 1600 |

*Ceramic Core (DP 12C), $\Phi = 40\%$, k = 210 mD
**Slug composition
6.9 wt % Shell sulfonate
20.6 wt % $D_2O$
2.8 wt % IPA
69.7 wt % Chlorocarbon ($C_4Cl_6$)
Slug relaxation characteristics: $f_s = 0.61$, $T_s = 90$ msec, $T_L = 770$ msec During the course of a field-scale flooding operation, cores are sometimes taken to determine the effect of the injected fluids on oil displacement, the state of the injected fluids and the conformance of the injected with ideal conditions. The originally injected fluids may be modified if such cores, when subjected to analysis by nuclear magnetic resonance detecting devices and other means, shown that there is a difference in the interaction between the injected fluids and fluids found in the newly taken core or that the interaction between the formation fluids and the injected fluids as modulated by time and distance within the reservoir are not as desirable as originally thought.

Another approach to the nuclear magnetic resonance analysis is as follows: The determination of the NMR output for each of the components can be done by calculating the output for each component based on an ideal miscible piston-like displacement (that is, using the assumption that the NMR relaxation rate, T, for each included component remains constant throughout the displacement process.) The NMR value for each component can then be calculated by means of a simple material balance which accounts for injection and production of fluids as displacement proceeds. These calculated NMR values for components can then be compared with measured NMR values for the composite system. This comparison can be repeated at a number of points during the displacement process and deviation from the ideal values minimized by substitution of components where necessary A more detailed discussion of the calculation is set forth below.

CALCULATION OF IDEAL DISPLACEMENT

| | Equation |
|---|---|
| $A_s(t) = f_s e^{-t/Ts}$ | 1 |
| $A_w(t) = f_w e^{-t/Tw}$ | 2 |
| $A_o(t) = f_o e^{-t/TW}$ | 3 |
| $A(t) = f_s e^{-t/Ts} + f_w e^{-t/Tw} + f_o e^{-t/To}$ | 4 |
| $A(t) = A_s(t) + A_w(t)\ A_o(t)$ | 5 |

where $A(t)$ is the amplitude $f$ is fraction of the component $t$ is time $T$ is the spin-lattice relaxation time of the component and the s, w and o denote components slug, water and oil respectively.

$A_s(t)$ is measured on rock and slug as discussed above and equation 1 used to calculate $T_s$, setting $f_s = 1$.

Similar measurements and calculations are made for $T_w$ and $T_o$.

The values of $T_w$, etc. are inserted into equation 4 for various pore volumes of displacement to arrive at the curve of theoretical piston-like displacement.

Now having described our invention what we claim is:

1. In an oil recovery operation wherein at least one fluid is injected into at least one well drilled into an oil-bearing formation permeable to a liquid to be injected into such well, the steps comprising a. measuring, with a nuclear magnetic resonance detecting device, any interaction between fluid sample(s), having nuclei detectable by an NMR detection device, injected into rock representative of a petroleum-bearing reservoir; with the rock and with fluid reasonably representative of the fluid(s) in said formation within said rock having nuclei detectable by an NMR detection device, and b. injecting into said formation fluid containing one or more of surfactant, cosurfactant and/or other semi-polar organic compound, said fluid being based on sample(s) shown to be minimally affected by the representative rock and fluids therein as determined by nuclear magnetic resonance.

2. The process of claim 1 wherein the fluid is injected during the course of changing the injectivity of all or a part of the formation adjacent an oil injection or production well.

3. The process of claim 1 wherein the fluid is injected during the course of the stimulation of an injection or production well.

4. The process of claim 1 wherein the analysis is conducted on a core taken from a well spaced at a distance from an original injection well and wherein fluid later injected is selected on the basis of nuclear magnetic resonance measurements taken in said core.

5. The process of designing fluids for injection comprising contacting a porous matrix substantially representative of a fluid-bearing subterranean formation containing fluids having nuclei detectable by nuclear magnetic resonance measuring devices, determining the NMR response of each nuclei-bearing fluid in association with said matrix, determining the NMR response of each fluid or component thereof to be brought into contact with the matrix, determining the NMR response of each such fluid or component thereof brought into contact with the matrix while in contact with fluids in association with said matrix, and contacting the formation with fluid which substantially meets predetermined criteria for interaction of the fluid(s) for injection with the matrix and/or fluid associated with the matrix, as established by said NMR response-determining steps.

6. The process of claim 5 wherein the predetermined criterion is that the fluid contacting the matrix does not substantially interact with fluid in association with the matrix and/or with the matrix.

7. The process of claim 5 wherein the predetermined criterion is that the fluid to be injected does not substantially interact with the matrix.

8. The process of claim 5 wherein the predetermined criterion is that the fluid contacting the matrix substantially interacts with fluid in association with the matrix and/or the matrix.

* * * * *